United States Patent [19]

Gradl et al.

[11] 4,008,000

[45] Feb. 15, 1977

[54] AXIAL-FLOW ROTOR WHEEL FOR HIGH-SPEED TURBOMACHINES

[75] Inventors: Ottmar Gradl, Munich; Wolf Loebel, Germering; Axel Rossmann, Karlsfeld; Herbert Zech, Neubiberg; Gerhard Zahring, Munich, all of Germany

[73] Assignee: Motoren-und Turbinen-Union Munich GmbH, Munich, Germany

[22] Filed: Aug. 4, 1975

[21] Appl. No.: 601,767

[30] Foreign Application Priority Data

Aug. 28, 1974 Germany ..... 2441249

[52] U.S. Cl. ..... 416/214 A; 416/218

[51] Int. Cl.[2] ..... F01D 5/30

[58] Field of Search ..... 416/214, 214 A, 215, 416/217, 135, 244 A

[56] References Cited

UNITED STATES PATENTS

| | | | |
|---|---|---|---|
| 927,515 | 7/1909 | Ehrhart | 416/214 A |
| 2,931,621 | 4/1960 | O'Donnell | 416/214 A X |
| 3,081,021 | 3/1963 | Castle et al. | 416/214 A |
| 3,694,104 | 9/1972 | Erwin | 416/230 X |

FOREIGN PATENTS OR APPLICATIONS

| | | | |
|---|---|---|---|
| 226,940 | 9/1958 | Australia | 416/215 |
| 619,513 | 5/1961 | Canada | 416/215 |
| 958,441 | 3/1950 | France | 416/214 A |
| 861,734 | 1/1953 | Germany | 416/214 |
| 897,415 | 5/1962 | United Kingdom | 416/215 |

*Primary Examiner*—Everette A. Powell, Jr.
*Attorney, Agent, or Firm*—Alan H. Levine

[57] ABSTRACT

A rotor wheel including a hub in the form of a thin-walled shell. Rotor blades are arranged in an annular pattern around the axis of the hub, each blade having at least one blade root formed with a hole. A pin extends through the hole in each blade root, and at least one retaining ring coaxial with the hub axis surrounds all the pins and absorbs radial forces produced by the blades on the pins when the rotor wheel rotates. The retaining rings and blades are fixed against axial and circumferential movement with respect to the hub. A segment between each pin and retaining ring distributes the forces of the pin to the retaining ring. The pins are mounted for radial movement with respect to the hub, and one of the mounting parts for said pins may be detachable from the hub. The hub may be dish shaped, and the pins secured at only one end to the peripheral wall of the hub, that wall having axial slots so that it may expand radially.

7 Claims, 5 Drawing Figures

AXIAL-FLOW ROTOR WHEEL FOR HIGH-SPEED TURBOMACHINES

This invention relates to an axial-flow rotor wheel for high-speed turbomachines using rotor blade retaining rings of boron, glass, or carbon fibers embedded in a heat-resistant matrix.

Such axial-flow rotor wheels have been disclosed in e.g., U.S. Pat. No. 3,095,138 and British Patent No. 1,170,593. In the U.S. patent, the retaining rings are provided in the shape of shrouds resting on the radially outer ends of the rotor blades, whereas in the British patent the rotor blades have hammerhead type pedestals with slots for embedding the retaining rings. While these previously disclosed arrangements simplify the design of the connection between the rotor disc and the rotor blade, they still require, as do conventional high-speed turbine rotors, use of a high-strength rotor disc requiring correspondingly great wall thickness and, thus, correspondingly great weight.

In general, the present invention provides a rotor wheel of especially light-weight construction for withstanding both extremely high speeds and high temperatures.

It is a particular object of the present invention to provide a rotor wheel of the type described above wherein use is made of a pin-type blade root attachment to secure the blades in several axially successive retaining rings, and wherein the blades are attached to the rotor hub, which is a thin-walled shell absorbing only moderate radial forces, merely for the purpose of locating the blades and transmitting circumferential forces.

It is known practice to reduce the weight of axial-flow rotor wheels by forming their outer portions with spokes extending at an angle to the radial direction. The spokes are connected at their radially outer ends to the wheel rim which is circumferentially divided into several sections by radially extending slots. The wheel rim is provided with several separate, circumferentially extending bands of wound boron or carbon fibers serving the function of locating the rotor blades radially in the wheel rim (see German Patent No. 2,027,861). While this known arrangement reduces the weight of axial-flow rotor wheels, and especially that of the rotor disk, as compared to the conventional construction, by the use of fiber-reinforced retaining rings, there still remains a relatively heavy central part, namely, the rotor disk.

Unlike the arrangement described above the arrangement of the present invention entirely eliminates the rotor disk, as conceived conventionally; the forces resulting from the centrifugal loads on the blades are transferred from the blades directly to the fiber-reinforced retaining rings. The rotor hub proper, which has the shape of a thin-walled cylindrical or conical shell, in this invention serves only the functions of locating the rotor blades centrally and transmitting circumferential forces, for which purpose the rotor hub may be made very light in weight because of the strength properties of thin-walled shells.

According to a feature of the present invention, the load on the fiber-reinforced retaining rings is equalized to a maximum extent and the generation of compressive stress concentrations is prevented because each pin is held by the retaining rings via intervening segments, the outer arcs of which have the same curvature as the associated retaining ring. Under centrifugal load, the snugly packed segments evenly spread the circumferential load on the retaining rings and, thus effect uniform circumferential stress.

According to a further feature of this invention, the pins are retained at both ends in radially extending slots in the rotor hub. This manner of locating the blades prevents any radial forces from being transmitted to the rotor hub since the pins are located radially only by the retaining rings and are free to move radially in the slots. Absorption of radial forces and absorption of circumferential forces, which are transferred through the side walls of the slots, are here completely separated one from the other.

According to a further feature of the present invention, the axial-flow rotor wheel serves primarily to facilitate installation of the row of blades on the hub by incorporating the radial slots on one side of the hub in a ring attachable and detachable from the front face of the hub. For assembly, the row of blades is thus completely assembled from the various blades, retaining rings, segments, and pins, and is then slid into place over the hub from the front face, after which the detachably attached ring is installed to locate the row of rotor blades axially on the hub.

According to a further embodiment of this invention, the pins are attached at only one end to a dish-shaped hub, the hub having several axial slots in the pin seating area. This manner of connecting the row of blades to the rotor hub represents an especially simple alternative approach in terms of design to the retention of the row of blades in radial slots at both ends of the pins. Several axially extending slots in the dish-shaped cylindrical, or alternatively conical, rotor hub enable the hub to expand in the pin area without absorbing appreciable radial forces in order to follow any elastic expansion of the retaining rings and, thus, of the row of blades.

Further objects and advantages of the present invention are described with reference to the accompanying drawings, in which.

Figure 2:
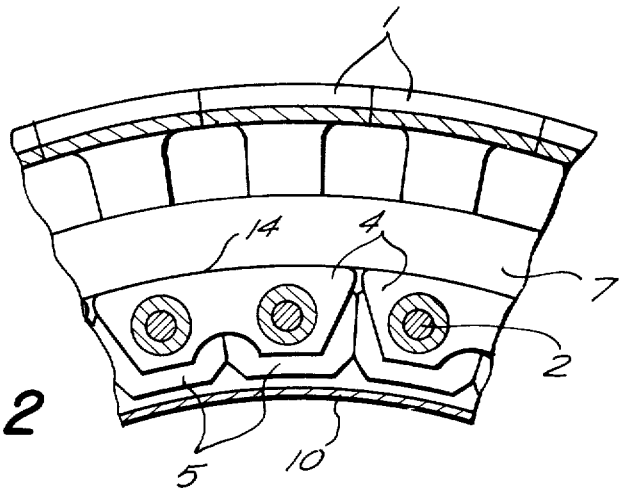
FIG. 2 is a sectional view taken along line 2—2 of FIG. 1.
Figure 1:
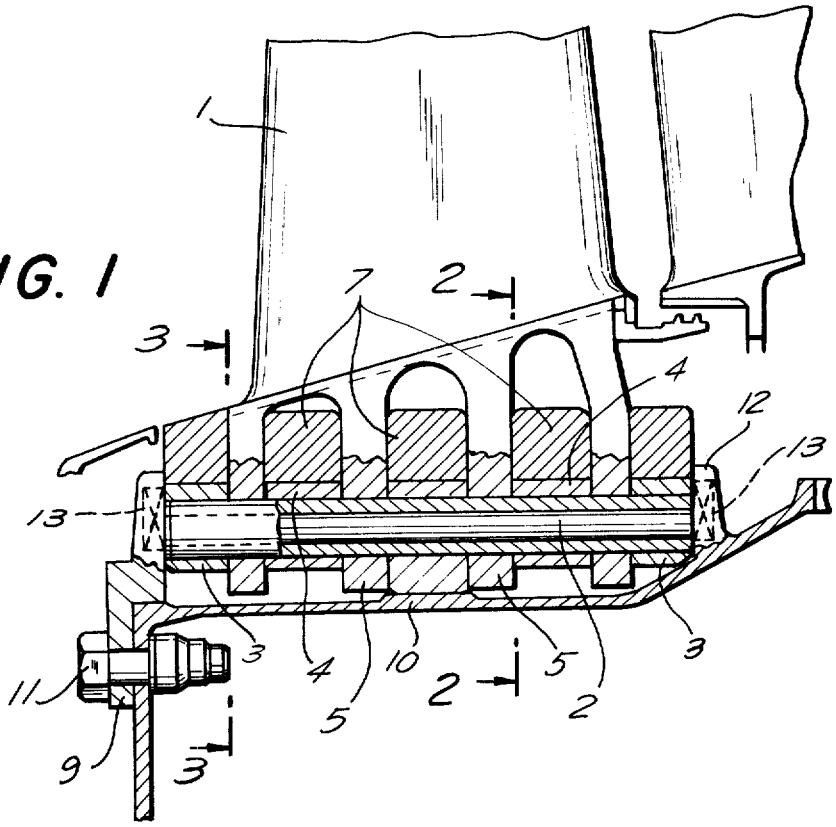
FIG. 1 is a fragmentary sectional view taken through the axis of rotation of an axial-flow rotor wheel assembled in accordance with the present invention, illustrating the point of connection between rotor blade and rotor hub.

With reference to FIG. 1, the numeral 10 indicates a rotor hub having the shape of a thin-walled cylindrical shell connected to a shaft by means of a likewise thin-walled, radially extending web not shown on the drawing. Axially extending pins 2 are used to seat axial-flow rotor blades 1 by their roots 5 in several axially successive retaining rings 7. For evenly spreading the loads on the retaining rings 7, when the latter are subject to centrifugal stress, the pins 2 do not directly abut the retaining rings 7, but are inserted in pairs into segments 4 (see FIGS. 2). However, the invention is not limited to the combination of the pins in pairs in a segment 4;

a segment 4 may optionally be provided for each pin. The outer arc 14 of the segment 4 has the same radius of curvature as the associated retaining ring 7 on which the segment 4 is seated.

Provided at both ends of the pins 2 are specially shaped segments 3, each of which is formed with a radially extending sliding cheek 13. The sliding cheeks 13 of the segments 3 are retained at the right-hand end (in FIG. 1) of the pins 2 in radially extending slots in a portion 12 of the rotor hub 10. At the left-hand end of the pins 2 the sliding cheeks 13 of the segments 3 are supported in a ring 9 which is attachable to and detachable from the front face of the hub 10. In FIG. 1, the ring 9 is firmly attached to the hub 10 by threaded fasteners 11, but use can also be made of other fastening means. Portion 12 and ring 9 prevent blades 1 and retaining rings 7 from moving axially and circumferentially with respect to hub 10. Alternatively, the pins 2 can be shaped at their ends to form sliding cheeks for movement in corresponding radial slots, in which case segments 3 can be eliminated. Freedom of radial movement of the pins 2 relative to the rotor hub 10 prevents the transfer of radial forces to the rotor hub 10, whereby radial forces are absorbed solely by the retaining rings 7. The retaining rings 7 consist of boron, glass, or carbon fibers embedded in a heat-resistant matrix.

Figure 4:
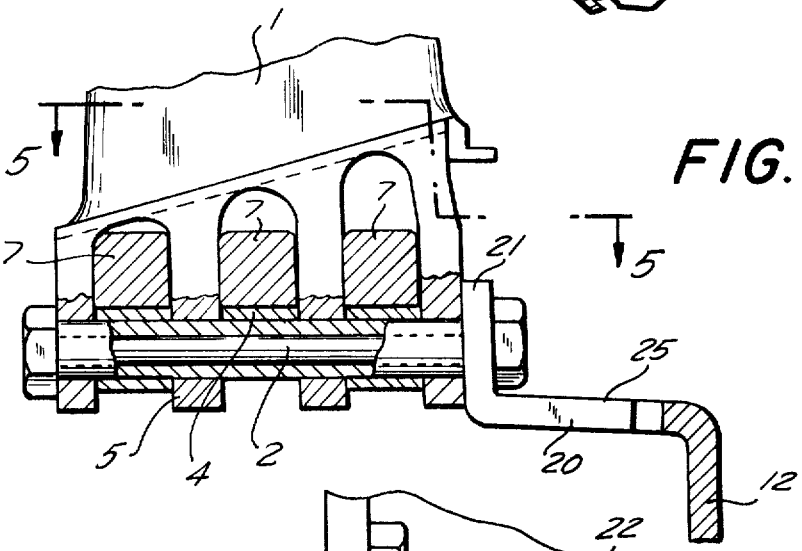
FIG. 4 is a sectional view, similar to FIG. 1, illustrating an alternative embodiment of an axial-flow rotor wheel assembled in accordance with the present invention.
Figure 5:
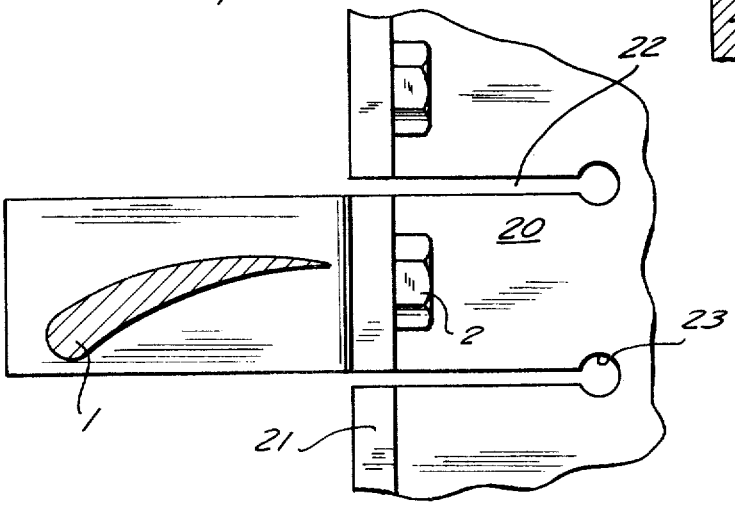
FIG. 5 is a sectional view taken along line 5—5 of FIG. 4.

Using the type of attachment shown in FIG. 4, wherein the same reference numerals are used for similar parts, between a row of rotor blades and a rotor hub, the transfer of radial forces to the rotor hub 12, which here takes the shape of a dish, is almost completely prevented. The hub 12 is provided with several axially extending slots (not shown) through which the pins 2 extend. A slot 22 is provided in the hub wall 25 for each segment 4, so that the hub wall 25 is divided in the area of attachment of the pins 2 into many separate, axially extending tangs 20. This enables the tangs 20, unilaterally secured to which is the entire row of blades by means of the bolts 2 and a collar 21, to follow the radial expansion of the row of blades with a minimum absorption of radial forces when the retaining rings 7 stretch under centrifugal load. As will be seen in FIG. 5, the slots 22 in the rotor hub 12 are stop-drilled at their roots 23 to prevent tearing as a result of aggrevated notch stresses.

Figure 3:
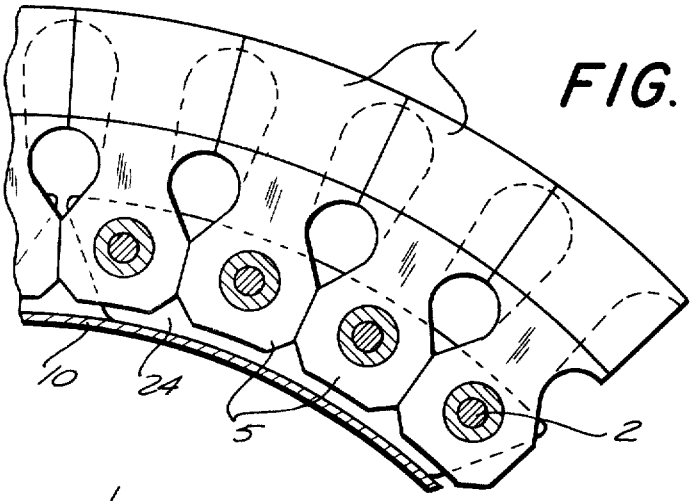
FIG. 3 is a sectional view taken along line 3—3 of FIG. 1, but showing the use of a larger segment.

As shown in FIG. 3, where four blades are attached in a segment 24, several blades 1 can be held by segments of larger size in the same manner in which two rotor blades are supported by a retaining ring 7 via each segment 4 in FIGS. 1 and 4.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. An axial-flow rotor wheel for a high-speed turbomachine comprising:
   a. a rotatable hub in the form of a thin-walled shell,
   b. rotor blades arranged in an annular pattern around the axis of said hub, each blade having at least one blade root formed with a hole,
   c. a pin extending parallel to the hub axis through the hole in each blade root,
   d. at least one retaining ring coaxial with said hub and surrounding said pins for absorbing the radial forces produced by the blades on said pins when the rotor wheel rotates, and
   e. means for preventing axial and circumferential movement of said pins with respect to said hub but for permitting radial movement of said pins with respect to said hub, whereby said retaining ring constitutes substantially the only means for resisting radial movement of said pins with respect to said hub.

2. An axial-flow rotor wheel as defined in claim 1 wherein each rotor blade has a plurality of axially spaced apart blade roots, and including a retaining ring between each two successive blade roots.

3. An axial-flow rotor wheel as defined in claim 1 including a segment between each pin and said ring for distributing the forces from said pins to said retaining ring, the outer surface of each segment having the same radius of curvature as the inner surface of said retaining ring.

4. An axial-flow rotor wheel as defined in claim 3 wherein each of said segments is between a plurality of said pins and said ring.

5. An axial-flow rotor wheel as defined in claim 1 wherein said means (e) includes parts fixed with respect to said hub, each of said parts having radially extending slots, and each end of each pin being slideably arranged in a slot in one of said parts, whereby radially outward movement of said pins is not transmitted to said hub.

6. An axial-flow rotor wheel as defined in claim 5 wherein one of said parts is a ring attachable to and detachable from one end of said hub.

7. An axial-flow rotor wheel as defined in claim 1 wherein said hub is dish shaped and said means (e) includes a hub peripheral wall, said pins being secured at only one end to said hub wall, and said hub wall having a series of axially extending slots in the region where said pins are secured to it.

* * * * *